US008886543B1

(12) United States Patent
Sharifi et al.

(10) Patent No.: US 8,886,543 B1
(45) Date of Patent: Nov. 11, 2014

(54) FREQUENCY RATIO FINGERPRINT CHARACTERIZATION FOR AUDIO MATCHING

(75) Inventors: Matthew Sharifi, Zurich (CH); George Tzanetakis, Victoria (CA); Annie Chen, Thalwil (CH); Dominik Roblek, Ruschlikon (CH)

(73) Assignee: Google Inc., Mountain View, CA (US)

( * ) Notice: Subject to any disclaimer, the term of this patent is extended or adjusted under 35 U.S.C. 154(b) by 435 days.

(21) Appl. No.: 13/296,899

(22) Filed: Nov. 15, 2011

(51) Int. Cl.
*G10L 11/00* (2006.01)

(52) U.S. Cl.
USPC ..... 704/270; 704/206; 704/243

(58) Field of Classification Search
USPC ..... 704/270, 271, 273, 200, 205, 206, 272, 704/243; 707/100
See application file for complete search history.

(56) References Cited

U.S. PATENT DOCUMENTS

| | | | | |
|---|---|---|---|---|
| 6,453,252 | B1 | 9/2002 | Laroche | |
| 6,721,488 | B1 | 4/2004 | Dimitrova et al. | |
| 7,516,074 | B2 | 4/2009 | Bilobrov | |
| 7,809,580 | B2 | 10/2010 | Hotho et al. | |
| 2002/0023020 | A1 | 2/2002 | Kenyon et al. | |
| 2003/0191764 | A1 * | 10/2003 | Richards | 707/100 |
| 2006/0122839 | A1 * | 6/2006 | Wang et al. | 704/273 |
| 2009/0012638 | A1 | 1/2009 | Lou | |

OTHER PUBLICATIONS

MusicBrainz—The Open Music Encyclopedia, http://musicbrainz.org, Last accessed Apr. 12, 2012.
Shazam, http://www.shazam.com, Last accessed Apr. 19, 2012.
Media Hedge, "Digital Fingerprinting," White Paper, Civolution and Gracenote, 2010, http://www.civolution.com/fileadmin/bestanden/white%20papers/Fingerprinting%20-%20by%20Civolution%20and%20Gracenote%20-%202010.pdf, Last accessed Jul. 11, 2012.
Milano, Dominic, "Content Control: Digital Watermarking and Fingerprinting," White Paper, Rhozet, a business unit of Harmonic Inc., http://www.rhozet.com/whitepapers/Fingerprinting_Watermarking.pdf, Last accessed Jul. 11, 2012.

* cited by examiner

*Primary Examiner* — Huyen X. Vo
(74) *Attorney, Agent, or Firm* — Amin, Turocy & Watson, LLP

(57) ABSTRACT

System and methods for characterizing interest points within a fingerprint are disclosed herein. The systems include generating a set of interest points and an anchor point related to an audio sample. A quantized absolute frequency of an anchor point can be calculated and used to calculate a set of quantized ratios. A fingerprint can then be generated based upon the set of quantized ratios and used in comparison to reference fingerprints to identify the audio sample. The disclosed systems and methods provide for an audio matching system robust to pitch-shift distortion by using quantized ratios within fingerprints rather than solely using absolute frequencies of interest points. Thus, the disclosed system and methods result in more accurate audio identification.

29 Claims, 8 Drawing Sheets

FREQUENCY RATIO FINGERPRINT CHARACTERIZATION FOR AUDIO MATCHING

TECHNICAL FIELD

This application relates to audio matching, and more particularly to characterizing fingerprints using frequency ratios.

BACKGROUND

Audio samples can be recorded by many commercially available electronic devices such as smart phones, tablets, e-readers, computers, personal digital assistants, personal media players, etc. Audio matching provides for the identification of a recorded audio sample by comparing the audio sample to a set of reference samples. To make the comparison, an audio sample can be transformed to a time-frequency representation of the sample by using, for example, a short time Fourier transform (STFT). Using the time-frequency representation, interest points that characterize time and/or frequency locations of peaks or other distinct patterns of the spectrogram can then be extracted from the audio sample. Fingerprints or descriptors can then be computed as functions of sets of interest points. Fingerprints of the audio sample can then be compared to fingerprints of reference samples to determine identity of the audio sample.

Pitch-shifting can affect an audio sample by shifting the frequency of interest points. For example, when trying to match audio played on the radio, television, or in a remix of a song, the speed of the audio sample may be slightly changed from the original. Samples that have altered speed will also likely have an altered pitch. Even a small pitch shift that is hard to notice for listeners may prevent difficult challenges in matching the signal. Therefore, characterizing interest points within a fingerprint in a manner that is robust to pitch shifting is desirable.

SUMMARY

The following presents a simplified summary of the specification in order to provide a basic understanding of some aspects of the specification. This summary is not an extensive overview of the specification. It is intended to neither identify key or critical elements of the specification nor delineate the scope of any particular embodiments of the specification, or any scope of the claims. Its sole purpose is to present some concepts of the specification in a simplified form as a prelude to the more detailed description that is presented in this disclosure.

Systems and methods disclosed herein relate to frequency characterization and audio matching. An interest point detection component can generate a set of interest points for an audio sample, wherein the set of interest points can contain an anchor point. A quantization component can generate a quantized absolute frequency of the anchor point and a set of quantized ratios based upon the set of interest points and the quantized absolute frequency of the anchor point. A fingerprint component can generate a fingerprint of the audio sample based upon the quantized absolute frequency of the anchor point and the set of quantized ratios.

The following description and the drawings set forth certain illustrative aspects of the specification. These aspects are indicative, however, of but a few of the various ways in which the principles of the specification may be employed. Other advantages and novel features of the specification will become apparent from the following detailed description of the specification when considered in conjunction with the drawings.

DETAILED DESCRIPTION

Figure 1:
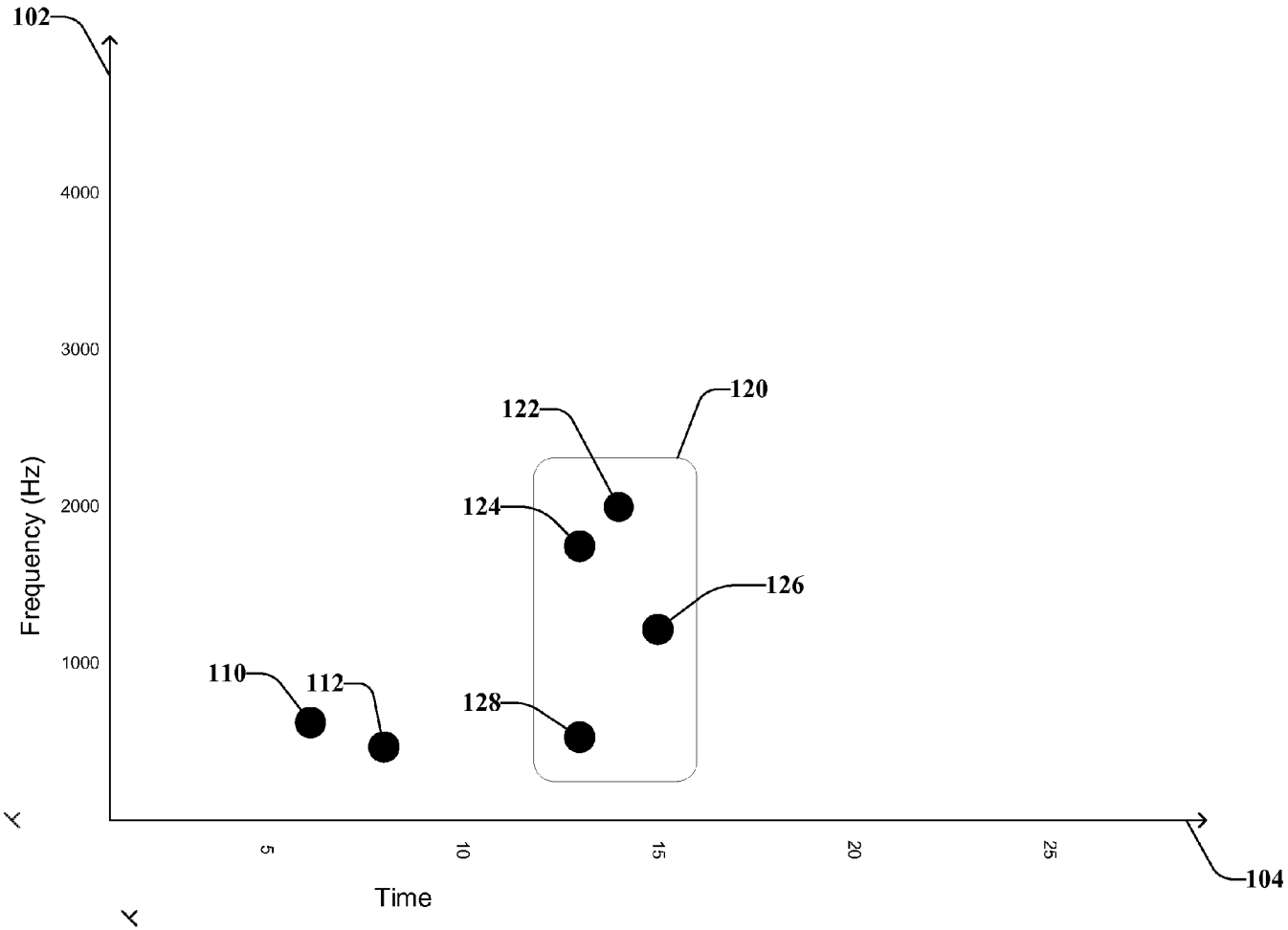
FIG. 1 illustrates an example time frequency plot of interest points and a fingerprint.

The innovation is now described with reference to the drawings, wherein like reference numerals are used to refer to like elements throughout. In the following description, for purposes of explanation, numerous specific details are set forth in order to provide a thorough understanding of this innovation. It may be evident, however, that the innovation can be practiced without these specific details. In other instances, well-known structures and devices are shown in block diagram form in order to facilitate describing the innovation. Audio matching in general involves analyzing an audio sample for unique characteristics that can be used in comparison to unique characteristics of reference samples to identify the audio sample. One way to identify unique characteristics of an audio sample is through the use of a spectrogram.

A spectrogram represents an audio sample by plotting time on the horizontal axis and frequency on the vertical axis. Additionally, amplitude or intensity of a certain frequency at a certain time can also be incorporated into the spectrogram by using color or a third dimension.

There are several different techniques for creating a spectrogram. One technique involves using a series of band-pass filters that can filter an audio sample at a specific frequency and measure amplitude of the audio sample at that specific frequency over time. The audio sample can be run through additional filters to individually isolate a set of frequencies to measure amplitude of the set of frequencies over time. A spectrogram can be created by combining all frequency measurements over time on a frequency axis which creates a spectrogram image of frequency amplitudes over time.

A second technique involves using short-time Fourier transform ("STFT") to break down an audio sample into time windows, where each window is Fourier transformed to calculate a magnitude of the frequency spectrum for the duration of each window. Combining a set of windows side by side on a time axis of the spectrogram creates an image of frequency amplitudes over time. Other techniques, such as wavelet transforms, can also be used to construct a spectrogram.

Creating and storing in a database an entire spectrogram for a set of reference samples can require large amounts of storage space and affect scalability of an audio matching system. Additionally, using an entire spectrogram to compare two audio samples may not be as tolerant to noise as the presence of noise can alter both the frequency and timing of sound events. Therefore, it can be desirable to instead calculate and store compact descriptors ("fingerprints") of reference samples versus an entire spectrogram that also are robust to noise. One method of calculating fingerprints is to first calculate individual interest points that identify unique characteristics of local features of the time-frequency representation of the reference sample. Fingerprints can then be computed as functions of sets of interest points.

Calculating interest points involves identifying unique characteristics of the spectrogram. For example, an interest point can be a spectral peak of a specific frequency over a specific window of time. As another non-limiting example, an interest point can also include timing of the onset of a note. Any suitable unique spectral event over a specific duration of time can constitute an interest point.

For an audio sample experiencing pitch-shift distortion, the frequency of interest points can be distorted in that the measured frequency of an audio sample experiencing a pitch-shift at a specific point in time may vary from a clean reference sample of the same audio that is not experiencing distortion. As interest points within a fingerprint represent unique frequency events at specific moments in time, pitch-shifted interest points within a fingerprint may lead to a failure in identification of the audio sample.

While pitch-shifted frequencies can misrepresent the identity of an audio sample, establishing an anchor point and calculating interest points as ratios based on the anchor point can greatly improve the robustness of a system to pitch-shift distortion.

Systems and methods herein provide for determining a quantized absolute frequency of an anchor point and generating fingerprints using quantized ratios of interest points based on the quantized absolute frequency of the anchor point. As pitch-shift distortion generally scales linearly, fingerprints containing a set of quantized ratios can be more robust to pitch shift distortion than fingerprints containing a set of quantized absolute frequencies.

Systems and methods herein can also identify an audio sample using fingerprints consisting of a quantized anchor point and a set of quantized ratios. As discussed in greater detail below, various implementations provide for characterizing interest point pruning methods to improve audio matching performance for samples suffering from distortion while also maintaining scalability.

Referring initially to FIG. 1 there is illustrated an example time frequency plot of interest points including an example fingerprint. Vertical axis 102 plots frequency, in this example in hertz (Hz). Horizontal axis 104 plots time. Interest points 110, 112, 122, 124, 126, and 128 correspond to spectral events at a specific time and frequency. For example, interest point 110 occurs at a time of 6 and at frequency of 625 Hz. Fingerprint 120 consists of interest points 122, 124, 126 and 128. It can be appreciated that every interest point within a fingerprint need not take place at the same time. It can be further appreciated that fingerprint 120 can consist of N number of interest points, where N is an integer, and is not limited to four as depicted in FIG. 1.

Figure 2A:
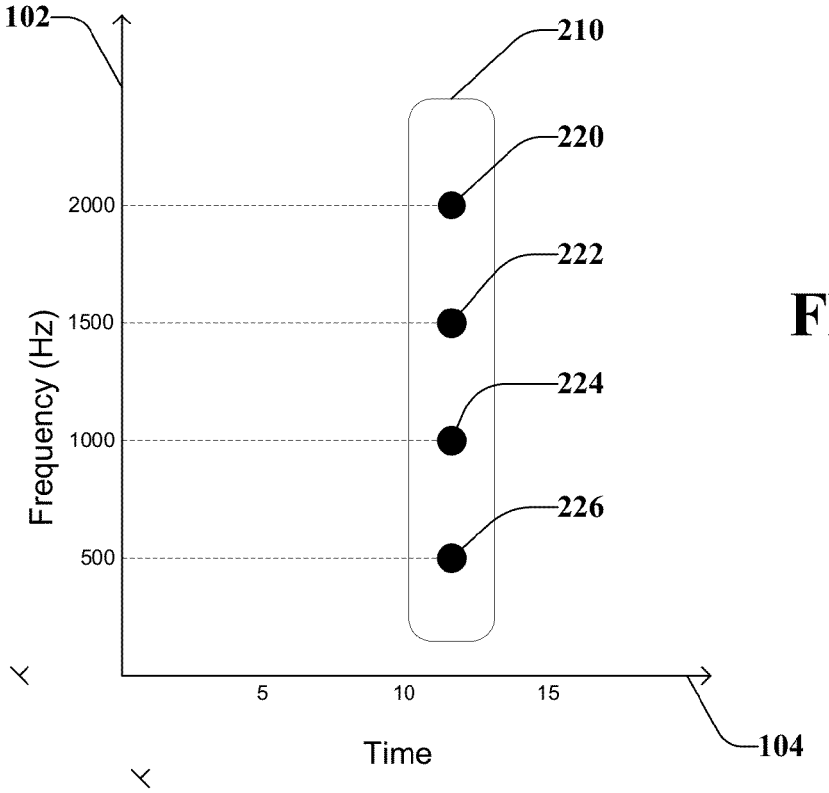
FIG. 2A illustrates an example time frequency plot of a fingerprint.

Referring now to FIG. 2A, there is illustrated an example time frequency plot of reference fingerprint 210. Reference fingerprint 210 consists of interest points 220, 222, 224, and 226. Frequency axis 102 is labeled with frequency measurements for interest points 220, 222, 224 and 226. For example, interest point 220 is located at 2,000 Hz whereas interest point 224 is located at 1,000 Hz. In this example, reference fingerprint 210 is based upon a clean audio sample suffering from no distortion.

Figure 2B:
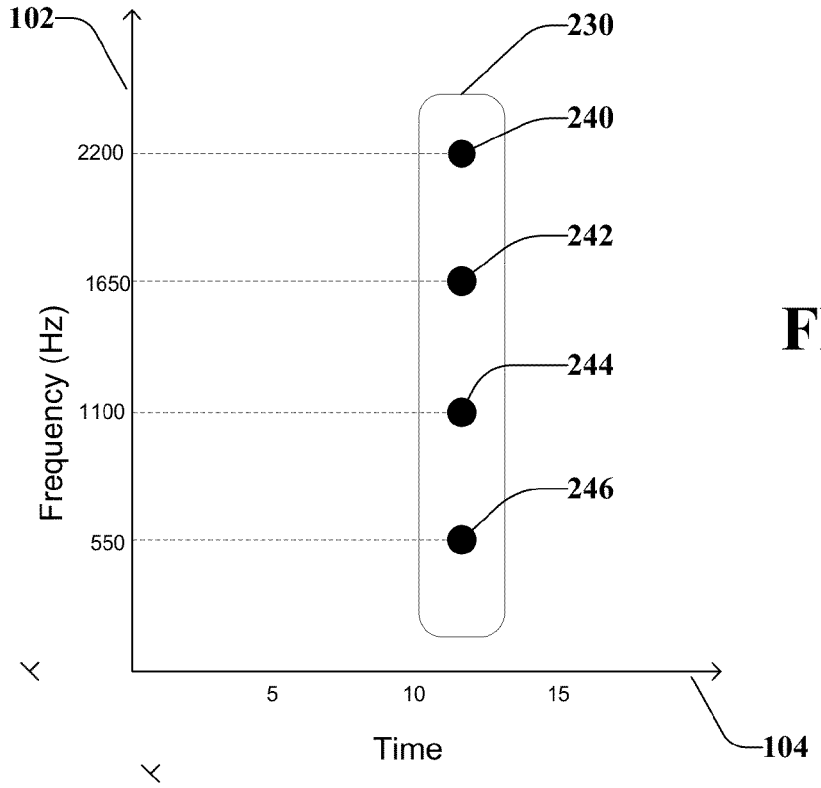
FIG. 2B illustrates an example time frequency plot of a pitch shifted fingerprint.

FIG. 2B illustrates an example time frequency plot of a pitch-shifted fingerprint 230 based upon a pitch-shifted audio sample. The clean audio sample used to generate reference fingerprint 210 has been pitch shifted in this example by ten percent to create pitch shifted fingerprint 230. It can be appreciated that each interest point within pitch shifted fingerprint 230 has been shifted ten percent higher on frequency axis 102 as compared to the interest points within reference fingerprint 210.

For example, the set of interest points within reference fingerprint 210 correspond to frequency measurements of: {500, 1000, 1500, 2000}. The set of interest points within pitch-shifted fingerprint 230 correspond to frequency measurements of: {550, 1100, 1650, 2200}. It can be appreciated that an audio matching system attempting to identify the pitch-shifted audio sample may not recognize that both reference fingerprint 210 and pitch-shifted fingerprint 230 relate to the same audio sample.

By assigning an anchor point and calculating frequency ratios, problems with pitch-shift distortion can be reduced or even negated. For example, referring back to reference fingerprint 210, interest point 226 can be assigned as an anchor point. Remaining interest points 220, 222, and 224 can then be calculated as ratios based on the anchor point. For example, interest point 220 located at 2000 Hz can be characterized as a ratio over the anchor point, i.e. two thousand hertz (2000 Hz) divided by five hundred hertz (500 Hz) equals four (4). Calculating similar ratios for interest points 222 and 224 gives a three number set of {4, 3, 2}.

Repeating the same characterization with pitch-shifted fingerprint 230 yields identical results. Using interest point 246 as the anchor point, interest point 240 is located at 2200 Hz and can be characterized as a ratio over the anchor point, i.e. twenty two hundred hertz (2200 Hz) divided by five hundred and fifty hertz (550 Hz) equals four (4). Continuing to characterize remaining interest points 242 and 244 yields an identical three number set {4, 3, 2} to that of reference fingerprint 210. Thus, using a set of ratios within a fingerprint instead of a set of absolute frequencies can allow for more accurate identification of an audio sample suffering from pitch-shift distortion.

In an implementation, the interest point selected as the anchor point can be the interest point with the lowest absolute frequency. It can be appreciated that any interest point can be selected as the anchor point so long as anchor points are assigned in a similar manner with regards to both the sample fingerprint and reference fingerprints.

Figure 3:
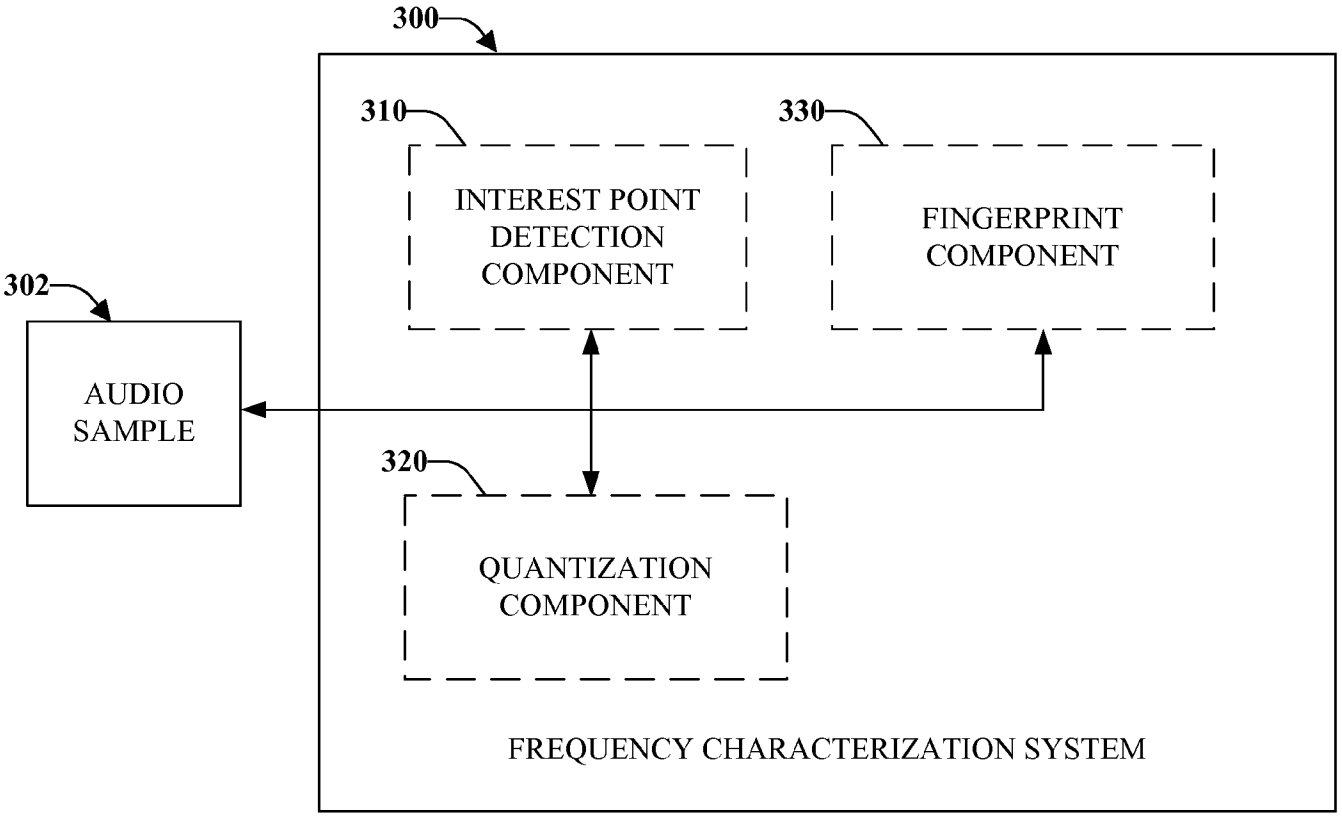
FIG. 3 illustrates a high-level functional block diagram of an example frequency characterization system in accordance with an implementation of this disclosure.

Referring now to FIG. 3, illustrated is a high-level functional block diagram of an example frequency characterization system 300 in accordance with an implementation of this disclosure. Frequency characterization system 300 includes an interest point detection component 310, a quantization component 320, and a fingerprint component 330.

Interest point detection component 310 can generate a set of interest points for audio sample 302 including an anchor point. It can be appreciated that the subject disclosure is not limited by the interest point detection method used by interest point detection component 310.

Quantization component 320 can generate a quantized absolute frequency of the anchor point. Quantization component 320 can further generate a set of quantized ratios based upon the set of interest points generated by interest point detection component 310 and the anchor point. In an implementation, quantization component 330 generates a set of quantized absolute frequencies for the set of interest points and can further generate the set of quantized ratios based upon the set of quantized absolute frequencies for the set of interest points.

Fingerprint component 330 can generate a fingerprint for audio sample 302 based upon the set of quantized ratios. In an implementation, fingerprint component 330 can generate a fingerprint for audio sample 302 further based upon the anchor point or the absolute quantized frequency of the anchor point.

Figure 4:
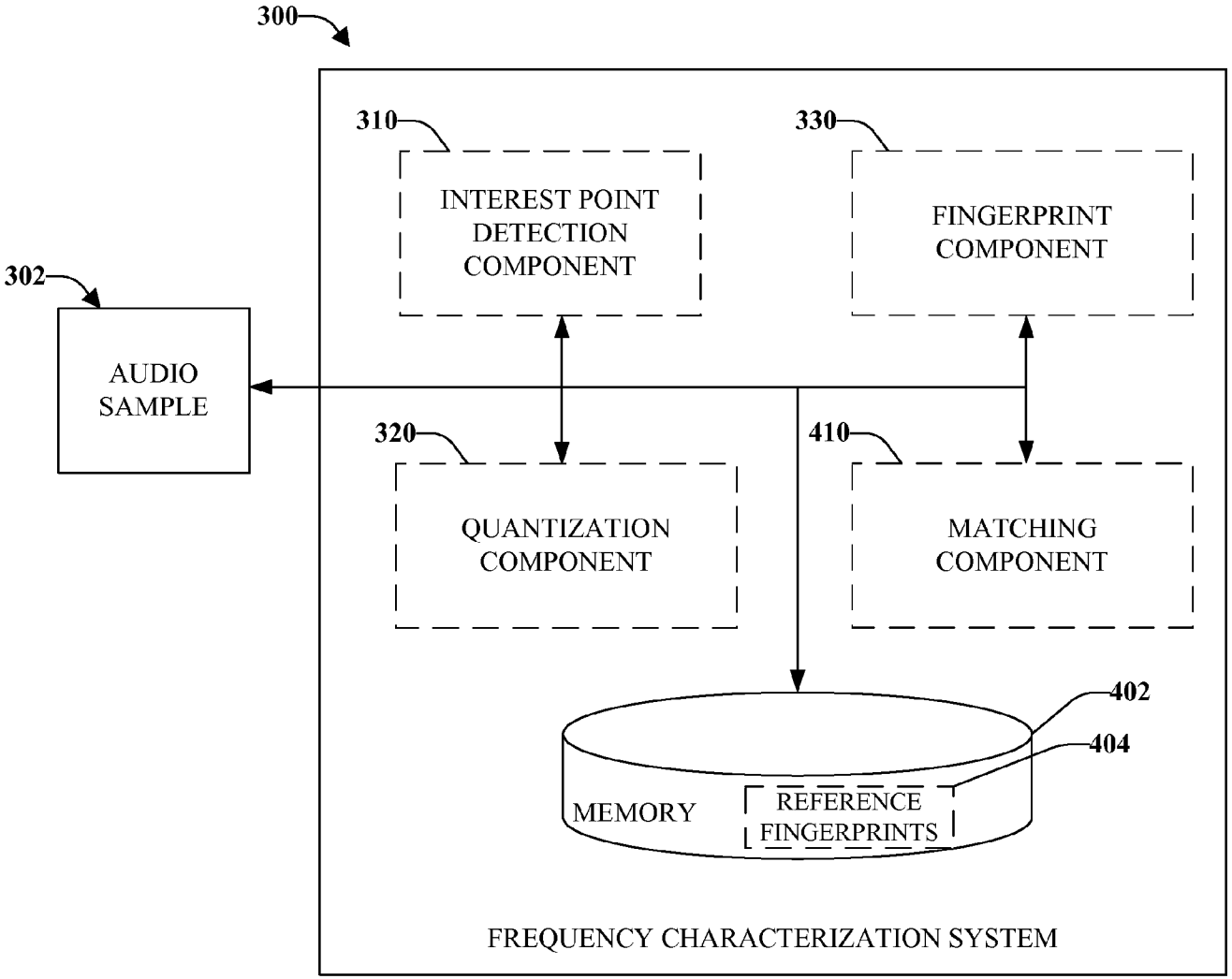
FIG. 4 illustrates a high-level functional block diagram of an example frequency characterization system including a matching component in accordance with an implementation of this disclosure.

FIG. 4 illustrates a high-level functional block diagram of an example frequency characterization system including a matching component 410 in accordance with an implementation of this disclosure. In FIG. 4, the frequency characterization system 300 also includes a memory 402 storing a plurality of reference fingerprints 404. Matching component 410 can identify the audio sample 302 based upon comparing the fingerprint generated by fingerprint component 330 with the plurality of reference fingerprints 404 stored in memory 402. It can be appreciated that reference fingerprints 404 can be based upon at least one of a reference anchor point, a quantized absolute frequency of the reference anchor point, or a set of quantized ratios in accordance with the subject disclosure.

Figure 5A:
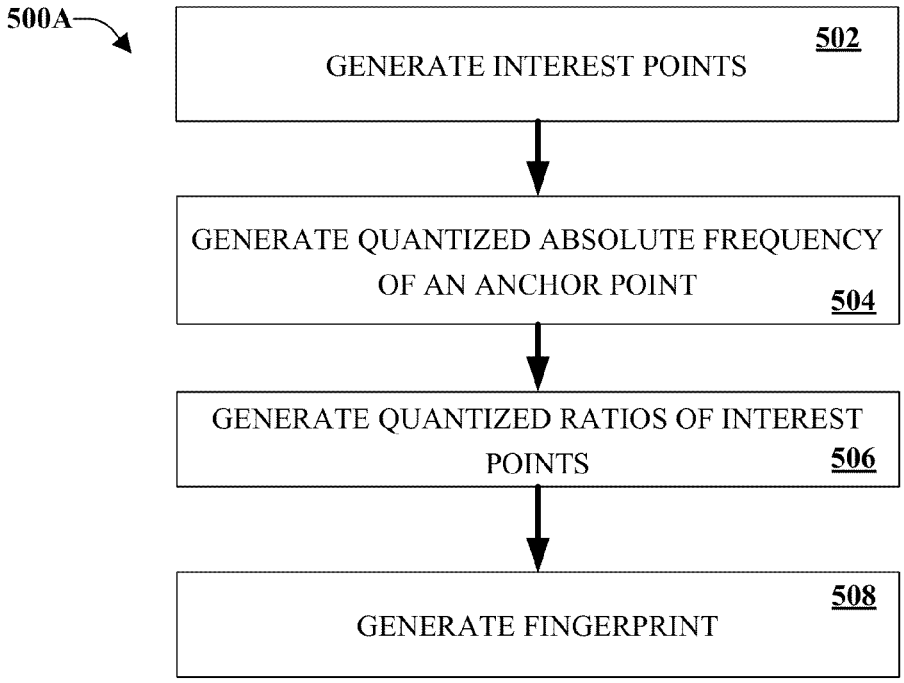
FIG. 5A illustrates an example methodology for frequency characterization of an audio sample in accordance with an implementation of this disclosure.
Figure 5B:
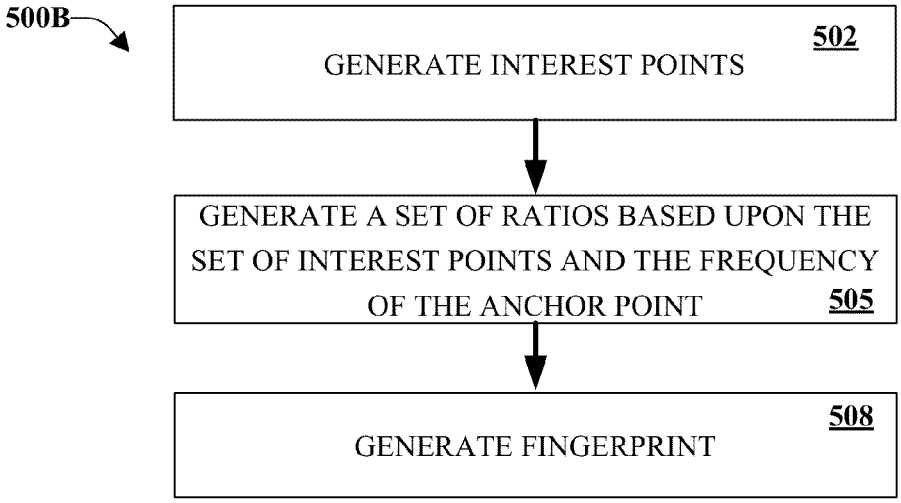
FIG. 5B illustrates an example methodology for frequency characterization of an audio sample in accordance with an implementation of this disclosure.
Figure 6:
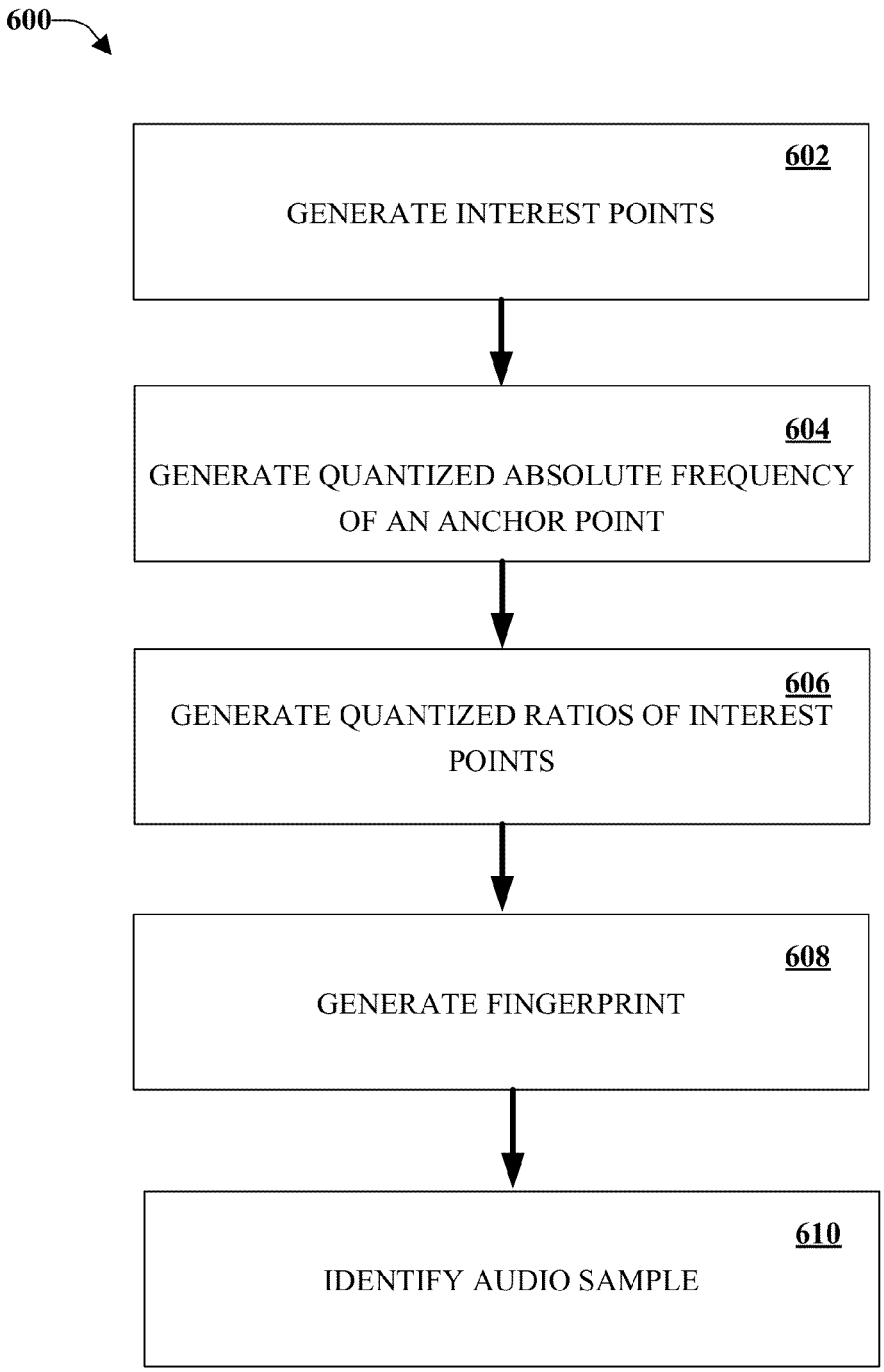
FIG. 6 illustrates an example methodology for frequency characterization of an audio sample including identifying the audio sample in accordance with an implementation of this disclosure.

FIGS. 5A, 5B, and 6 illustrate methodologies and/or flow diagrams in accordance with this disclosure. For simplicity of explanation, the methodologies are depicted and described as a series of acts. However, acts in accordance with this disclosure can occur in various orders and/or concurrently, and with other acts not presented and described herein. Furthermore, not all illustrated acts may be required to implement the methodologies in accordance with the disclosed subject matter. In addition, those skilled in the art will understand and appreciate that the methodologies could alternatively be represented as a series of interrelated states via a state diagram or events. Additionally, it should be appreciated that the methodologies disclosed in this specification are capable of being stored on an article of manufacture to facilitate transporting and transferring such methodologies to computing devices. The term article of manufacture, as used herein, is intended to encompass a computer program accessible from any computer-readable device or storage media.

Moreover, various acts have been described in detail above in connection with respective system diagrams. It is to be appreciated that the detailed description of such acts in the prior figures can be and are intended to be implementable in accordance with the following methodologies.

FIG. 5A illustrates an example methodology 500A for characterizing frequency information within a fingerprint in accordance with an implementation of this disclosure. At 502, a set of interest points can be generated (e.g., by an interest point detection component 310) for an audio sample wherein the set of interest points contains an anchor point. At 504, a quantized absolute frequency of the anchor point can be generated (e.g., by a quantization component 320). At 506, a set of quantized ratios can be generated (e.g., by quantization component 320) based upon the set of interest points and the quantized absolute frequency of the anchor point. At 508, a fingerprint of the audio sample can be generated (e.g., by a fingerprint component 330) based upon the set of quantized ratios.

FIG. 5B illustrates an example methodology 500B for characterizing frequency information within a fingerprint in accordance with an implementation of this disclosure. At 502, a set of interest points can be generated (e.g., by an interest point detection component 310) for an audio sample wherein the set of interest points contains an anchor point. At 505, a set of ratios can be generated (e.g., by quantization component 320) based upon the set of interest points and the frequency of the anchor point. In an exemplary implementation, the set of ratios are a set of quantized ratios. At 508, a fingerprint of the audio sample can be generated (e.g., by a fingerprint component 330) based upon the set of ratios.

FIG. 6 illustrates an example methodology 600 for using characterized frequency information to identify an audio sample in accordance with an implementation of this disclosure. At 602, a set of interest points can be generated (e.g., by an interest point detection component 310) for an audio sample wherein the set of interest points contains an anchor point. At 604, a quantized absolute frequency of the anchor point can be generated (e.g., by a quantization component 320). At 606, a set of quantized ratios can be generated (e.g., by quantization component 320) based upon the set of interest points and the quantized absolute frequency of the anchor point. At 608, a fingerprint of the audio sample can be generated (e.g., by a fingerprint component 330) based upon the set of quantized ratios.

At 610, the audio sample can be identified (e.g., by a matching component 410) based upon comparing the fingerprint with a plurality of reference fingerprints. Reference fingerprints can be based upon a quantized absolute frequency of a reference anchor point and a set of quantized ratios.

Reference throughout this specification to "one implementation," or "an implementation," means that a particular feature, structure, or characteristic described in connection with the implementation is included in at least one implementation. Thus, the appearances of the phrase "in one implementation," or "in an implementation," in various places throughout this specification are not necessarily all referring to the same implementation. Furthermore, the particular features, structures, or characteristics may be combined in any suitable manner in one or more implementations.

To the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

As used in this application, the terms "component," "module," "system," or the like are generally intended to refer to a computer-related entity, either hardware (e.g., a circuit), a combination of hardware and software, or an entity related to an operational machine with one or more specific functionalities. For example, a component may be, but is not limited to being, a process running on a processor (e.g., digital signal processor), a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers. Further, a "device" can come in the form of specially designed hardware; generalized hardware made specialized by the execution of software thereon that enables hardware to perform specific functions (e.g. generating interest points and/or fingerprints); software on a computer readable medium; or a combination thereof.

The aforementioned systems, circuits, modules, and so on have been described with respect to interaction between several components and/or blocks. It can be appreciated that such systems, circuits, components, blocks, and so forth can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components, and any one or more middle layers, such as a management layer, may be provided to communicatively couple to such sub-components in order to provide integrated functionality. Any components described herein may also interact with one or more other components not specifically described herein but known by those of skill in the art.

Moreover, the words "example" or "exemplary" are used herein to mean serving as an example, instance, or illustration. Any aspect or design described herein as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Figure 7:
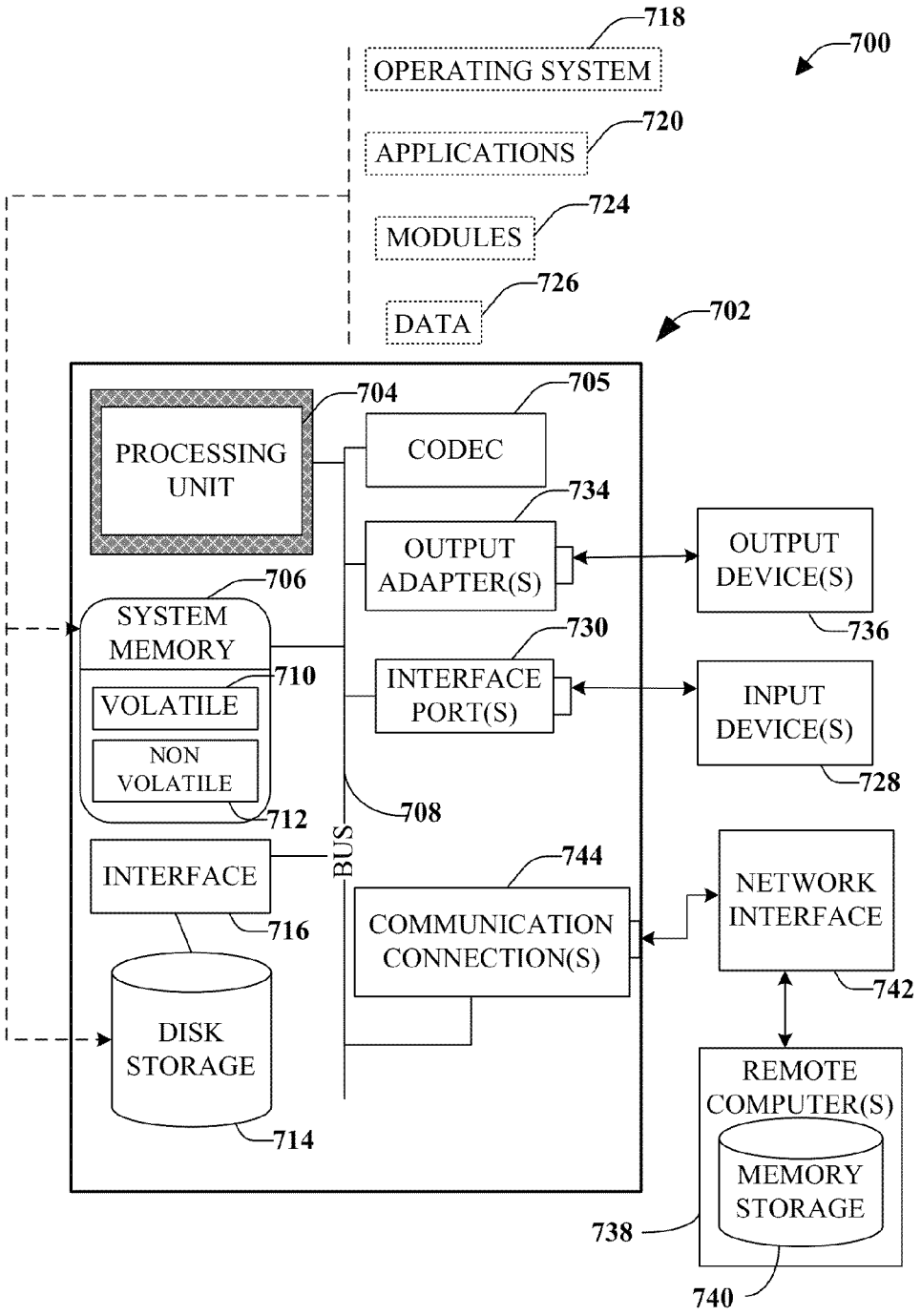
FIG. 7 illustrates an example block diagram of a suitable environment for implementing various aspects of the disclosed subject matter.

With reference to FIG. 7, a suitable environment 700 for implementing various aspects of the disclosed subject matter includes a computer 702. The computer 702 includes a processing unit 704, a system memory 706, a codec 705, and a system bus 708. The system bus 708 couples system components including, but not limited to, the system memory 706 to the processing unit 704. The processing unit 704 can be any of various available processors. Dual microprocessors and other multiprocessor architectures also can be employed as the processing unit 704.

The system bus 708 can be any of several types of bus structure(s) including the memory bus or memory controller, a peripheral bus or external bus, and/or a local bus using any variety of available bus architectures including, but not limited to, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Personal Computer Memory Card International Association bus (PCMCIA), Firewire (IEEE 1394), and Small Computer Systems Interface (SCSI).

The system memory 706 includes volatile memory 710 and non-volatile memory 712. The basic input/output system (BIOS), containing the basic routines to transfer information between elements within the computer 702, such as during start-up, is stored in non-volatile memory 712. By way of illustration, and not limitation, non-volatile memory 712 can include read only memory (ROM), programmable ROM (PROM), electrically programmable ROM (EPROM), electrically erasable programmable ROM (EEPROM), or flash memory. Volatile memory 710 includes random access memory (RAM), which acts as external cache memory. According to present aspects, the volatile memory may store the write operation retry logic (not shown in FIG. 7) and the like. By way of illustration and not limitation, RAM is available in many forms such as static RAM (SRAM), dynamic RAM (DRAM), synchronous DRAM (SDRAM), double data rate SDRAM (DDR SDRAM), enhanced SDRAM (ESDRAM).

Computer 702 may also include removable/non-removable, volatile/non-volatile computer storage media. FIG. 7 illustrates, for example, a disk storage 714. Disk storage 714 includes, but is not limited to, devices like a magnetic disk drive, solid state disk (SSD) floppy disk drive, tape drive, Jaz drive, Zip drive, LS-100 drive, flash memory card, or memory stick. In addition, disk storage 714 can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage devices 714 to the system bus 708, a removable or non-removable interface is typically used, such as interface 716.

It is to be appreciated that FIG. 7 describes software that acts as an intermediary between users and the basic computer resources described in the suitable operating environment 700. Such software includes an operating system 718. Operating system 718, which can be stored on disk storage 714, acts to control and allocate resources of the computer system 702. Applications 720 take advantage of the management of resources by operating system 718 through program modules 724, and program data 726, such as the boot/shutdown transaction table and the like, stored either in system memory 706 or on disk storage 714. It is to be appreciated that the claimed subject matter can be implemented with various operating systems or combinations of operating systems.

A user enters commands or information into the computer 702 through input device(s) 728. Input devices 728 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to the processing unit 704 through the system bus 708 via interface port(s) 730. Interface port(s) 730 include, for example, a serial port, a parallel port, a game port, and a universal serial bus (USB). Output device(s) 736 use some of the same type of ports as input device(s) 728. Thus, for example, a USB port may be used to provide input to computer 702, and to output information from computer 702 to an output device 736. Output adapter 734 is provided to illustrate that there are some output devices 736 like monitors, speakers, and printers, among other output devices 736, which require special adapters. The output adapters 734 include, by way of illustration and not limitation, video and sound cards that provide a means of connection between the output device 736 and the system bus 708. It should be noted that other devices and/or systems of devices provide both input and output capabilities such as remote computer(s) 738.

Computer 702 can operate in a networked environment using logical connections to one or more remote computers, such as remote computer(s) 738. The remote computer(s) 738 can be a personal computer, a server, a router, a network PC, a workstation, a microprocessor based appliance, a peer device, a smart phone, a tablet, or other network node, and typically includes many of the elements described relative to computer 702. For purposes of brevity, only a memory storage device 740 is illustrated with remote computer(s) 738. Remote computer(s) 738 is logically connected to computer 702 through a network interface 742 and then connected via communication connection(s) 744. Network interface 742 encompasses wire and/or wireless communication networks such as local-area networks (LAN) and wide-area networks (WAN) and cellular networks. LAN technologies include Fiber Distributed Data Interface (FDDI), Copper Distributed Data Interface (CDDI), Ethernet, Token Ring and the like. WAN technologies include, but are not limited to, point-to-point links, circuit switching networks like Integrated Services Digital Networks (ISDN) and variations thereon, packet switching networks, and Digital Subscriber Lines (DSL).

Communication connection(s) 744 refers to the hardware/software employed to connect the network interface 742 to the bus 708. While communication connection 744 is shown for illustrative clarity inside computer 702, it can also be external to computer 702. The hardware/software necessary for connection to the network interface 742 includes, for exemplary purposes only, internal and external technologies such as, modems including regular telephone grade modems, cable modems and DSL modems, ISDN adapters, and wired and wireless Ethernet cards, hubs, and routers.

Figure 8:
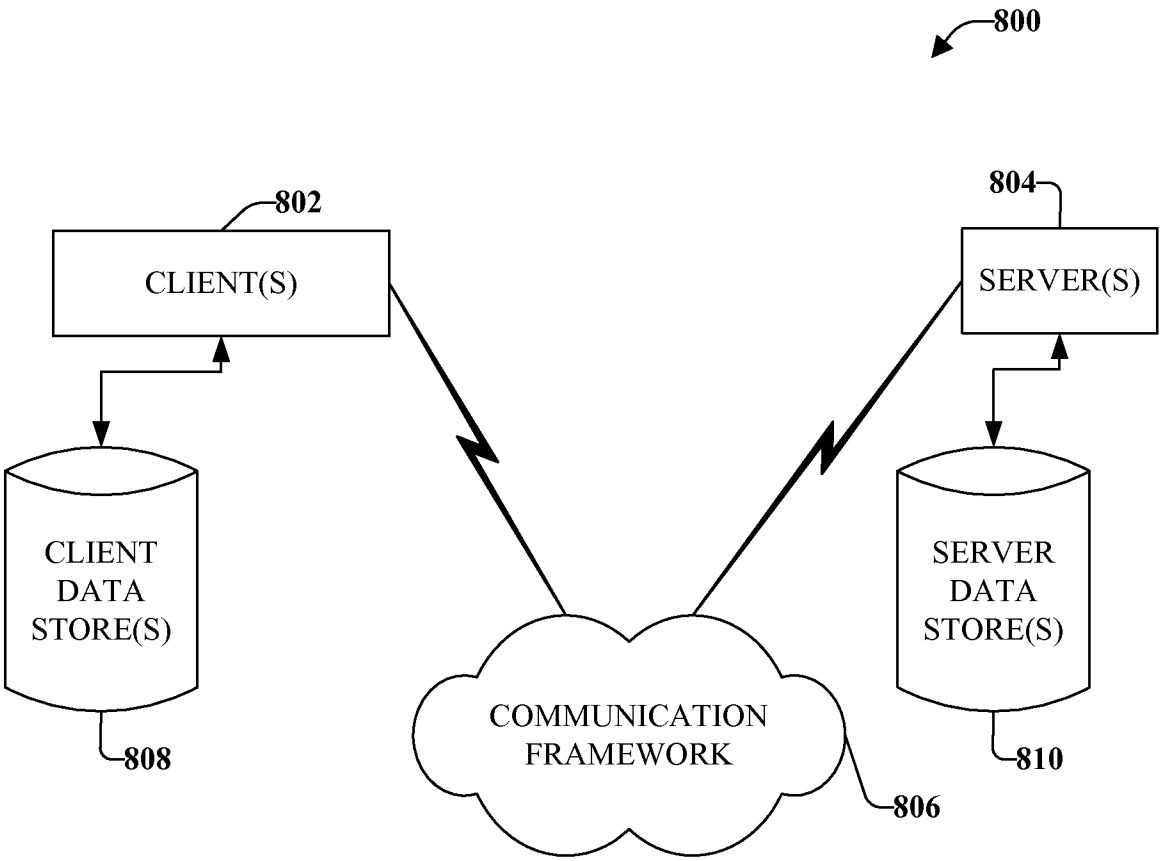
FIG. 8 illustrates an example schematic block diagram for a computing environment in accordance with this disclosure.

Referring now to FIG. 8, there is illustrated a schematic block diagram of a computing environment 800 in accordance with this disclosure. The system 800 includes one or more client(s) 802, which can include an application or a system that accesses a service on the server 804. The client(s) 802 can be hardware and/or software (e.g., threads, processes, computing devices). The client(s) 802 can house cookie(s), metadata, and/or associated contextual information about the audio sample, for example.

The system 800 also includes one or more server(s) 804. The server(s) 804 can also be hardware or hardware in combination with software (e.g., threads, processes, computing devices). The servers 804 can house threads to perform, for example, interest point detection, quantization, fingerprint generation, or fingerprint comparisons in accordance with the subject disclosure. One possible communication between a client 802 and a server 804 can be in the form of a data packet adapted to be transmitted between two or more computer processes where the data packet contains, for example, an audio sample. The data packet can include a cookie and/or associated contextual information, for example. The system 800 includes a communication framework 806 (e.g., a global communication network such as the Internet) that can be employed to facilitate communications between the client(s) 802 and the server(s) 804.

Communications can be facilitated via a wired (including optical fiber) and/or wireless technology. The client(s) 802 are operatively connected to one or more client data store(s) 808 that can be employed to store information local to the client(s) 802 (e.g., cookie(s) and/or associated contextual information). Similarly, the server(s) 804 are operatively connected to one or more server data store(s) 810 that can be employed to store information local to the servers 804.

The illustrated aspects of the disclosure may also be practiced in distributed computing environments where certain tasks are performed by remote processing devices that are linked through a communications network. In a distributed computing environment, program modules can be located in both local and remote memory storage devices.

The systems and processes described above can be embodied within hardware, such as a single integrated circuit (IC) chip, multiple ICs, an application specific integrated circuit (ASIC), or the like. Further, the order in which some or all of the process blocks appear in each process should not be deemed limiting. Rather, it should be understood that some of the process blocks can be executed in a variety of orders, not all of which may be explicitly illustrated herein.

What has been described above includes examples of the implementations of the present invention. It is, of course, not possible to describe every conceivable combination of components or methodologies for purposes of describing the claimed subject matter, but many further combinations and permutations of the subject innovation are possible. Accordingly, the claimed subject matter is intended to embrace all such alterations, modifications, and variations that fall within the spirit and scope of the appended claims. Moreover, the above description of illustrated implementations of this disclosure, including what is described in the Abstract, is not intended to be exhaustive or to limit the disclosed implementations to the precise forms disclosed. While specific implementations and examples are described herein for illustrative purposes, various modifications are possible that are considered within the scope of such implementations and examples, as those skilled in the relevant art can recognize.

In particular and in regard to the various functions performed by the above described components, devices, circuits, systems and the like, the terms used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the claimed subject matter. In this regard, it will also be recognized that the innovation includes a system as well as a computer-readable storage medium having computer-executable instructions for performing the acts and/or events of the various methods of the claimed subject matter.

What is claimed is:

1. A system, comprising:

a memory that stores computer executable components; and a processor that executes the following computer executable components stored within the memory;

an interest point detection component that:

generates a set of interest points for an audio sample; and selects an interest point with a lowest absolute frequency from the set of interest points as an anchor point;

a quantization component that generates a quantized absolute frequency of the anchor point and a set of quantized ratios based upon the set of interest points and the quantized absolute frequency of the anchor point; and a fingerprint component that generates a fingerprint of the audio sample comprising the set of quantized ratios and at least one of the anchor point or the quantized absolute frequency of the anchor point.

2. The system of claim 1, wherein the quantization component generates a set of quantized absolute frequencies for the set of interest points.

3. The system of claim 2, wherein the fingerprint component generates the set of quantized ratios further using the set of quantized frequencies.

4. The system of claim 1, wherein the fingerprint further comprises at least one of the anchor point or the quantized absolute frequency of the anchor point.

5. The system of claim 1, further comprising:

a matching component that identifies the audio sample based upon comparing the fingerprint with a plurality of reference fingerprints.

6. The system of claim 5, wherein the plurality of reference fingerprints are based upon a reference anchor point.

7. The system of claim 5 wherein the plurality of reference fingerprints are based upon a quantized absolute frequency of the reference anchor point.

8. The system of claim 5 wherein the plurality of reference fingerprints are based upon a set of reference quantized ratios.

9. The system of claim 8, wherein the set of reference quantized ratios are based upon the quantized absolute frequency of the reference anchor point and a set of reference interest points.

10. A method comprising:

generating, by a device including a processor, a set of interest points for an audio sample;

selecting, by the device, an interest point with a lowest absolute frequency from the set of interest points as an anchor point;

generating, by the device, a quantized absolute frequency of the anchor point;

generating, by the device, a set of quantized ratios based upon the set of interest points and the quantized absolute frequency of the anchor point; and generating, by the device, a fingerprint of the audio sample having components representing the set of quantized ratios and at least one of the anchor point or the quantized absolute frequency of the anchor point.

11. The method of claim 10, further comprising generating, by the device, a set of quantized absolute frequencies for the set of interest points.

12. The method of claim 11, wherein generating the set of quantized ratios is further based upon the set of quantized absolute frequencies.

13. The method of claim 10, further comprising:

identifying, by the device, the audio sample based upon comparing the fingerprint with a plurality of reference fingerprints.

14. The method of claim 13, wherein the plurality of reference fingerprints are based upon a quantized absolute frequency of a reference anchor point and a set of reference quantized ratios.

15. The method of claim 14, wherein the set of reference quantized ratios are based upon the quantized absolute frequency of the reference anchor point and a set of reference interest points.

16. The method of claim 10, wherein the fingerprint comprises at least one of the anchor point or the quantized absolute frequency of the anchor point.

17. A non-transitory computer-readable medium having instructions stored thereon that, in response to execution, cause a system including a processor to perform operations comprising:

generating a set of interest points for an audio sample;

selecting an interest point with a lowest absolute frequency from the set of interest points as an anchor point;

generating a quantized absolute frequency of the anchor point;

generating a set of quantized ratios based upon the set of interest points and the quantized absolute frequency of the anchor point; and generating a fingerprint of the audio sample comprising a representation of the set of quantized ratios and at least one of the anchor point or the quantized absolute frequency of the anchor point.

18. The non-transitory computer-readable medium of claim 17, the operations further comprising generating a set of quantized absolute frequencies for the set of interest points.

19. The non-transitory computer-readable medium of claim 18, the operations further comprising generating the set of quantized ratios further using the set of quantized absolute frequencies.

20. The non-transitory computer-readable medium of claim 17, further comprising:

identifying the audio sample based upon comparing the fingerprint with a plurality of reference fingerprints.

21. The non-transitory computer-readable medium of claim 20, wherein the plurality of reference fingerprints are based upon a quantized absolute frequency of a reference anchor point and a set of reference quantized ratios.

22. The non-transitory computer-readable medium of claim 21, wherein the set of reference quantized ratios are based upon the quantized absolute frequency of the reference anchor point and a set of reference interest points.

23. A method comprising:

generating, by a device including a processor, a set of interest points for an audio sample;

selecting, by the device, an interest point with a lowest absolute frequency from the set of interest points as an anchor point;

generating, by the device, a set of ratios based upon the set of interest points and the anchor point; and generating, by the device, a fingerprint of the audio sample comprising the set of ratios and the anchor point.

24. The method of claim 23, further comprising generating, by the device, a set of quantized absolute frequencies for the set of interest points.

25. The method of claim 24, wherein generating the set of ratios is further based upon the set of quantized absolute frequencies and the anchor point.

26. The method of claim 23, further comprising:

identifying, by the device, the audio sample based upon comparing the fingerprint with a plurality of reference fingerprints.

27. The method of claim 26, wherein the plurality of reference fingerprints are based upon a reference anchor point and a set of reference ratios.

28. The method of claim 27, wherein the set of reference ratios are based upon the reference anchor point and a set of reference interest points.

29. The method of claim 23, wherein the fingerprint comprises the anchor point.

* * * * *